US005880420A

United States Patent [19]

Rohmer et al.

[11] Patent Number: 5,880,420

[45] Date of Patent: Mar. 9, 1999

[54] SWITCH OPERATOR WITH INTERLOCK MECHANISM

[75] Inventors: Richard M Rohmer, Jordan, N.Y.; Eric C Johnson, Mountain Top, Pa.

[73] Assignee: Pass & Seymour, Inc., Syracuse, N.Y.

[21] Appl. No.: 837,926

[22] Filed: Apr. 11, 1997

[51] Int. Cl.[6] ..... H01H 9/20; H01R 33/96

[52] U.S. Cl. ..... 200/50.28

[58] Field of Search ..... 200/50.28, 50.29, 200/50.3, 50.31, 50.32, 51.09, 51.1

[56] References Cited

U.S. PATENT DOCUMENTS

| | | | |
|---|---|---|---|
| Re. 32,340 | 1/1987 | Dobson et al. | 200/50.28 |
| 1,556,831 | 10/1925 | Wyman | 200/18 |
| 1,731,417 | 10/1929 | Hartwig | 200/50.29 |
| 1,798,244 | 3/1931 | Woodworth | 200/50.28 |
| 1,818,290 | 8/1931 | Wulle | 200/50.3 |
| 1,924,691 | 1/1933 | Lofgren | 200/50.29 |
| 1,934,024 | 11/1933 | Anderson | 200/50.29 |
| 1,971,990 | 1/1934 | Reynolds et al. | 200/50.28 |
| 2,015,543 | 9/1935 | Bissell | 200/50.3 |
| 2,241,828 | 5/1941 | Reynolds | 200/50.3 |
| 3,277,253 | 10/1966 | Bacon | 200/50.29 |
| 3,286,051 | 11/1966 | Mackiewicz | 200/50.29 |
| 3,475,570 | 10/1969 | Appleton | 200/51.07 |
| 3,523,166 | 8/1970 | Daly | 200/50.29 |
| 3,585,323 | 6/1971 | Appleton et al. | 200/50.3 |
| 3,598,941 | 8/1971 | Nelson | 200/50.31 X |
| 3,716,683 | 2/1973 | Hafer | 200/50.29 |
| 3,735,078 | 5/1973 | Appleton et al. | 200/50.29 |
| 3,982,804 | 9/1976 | Marechal | 439/188 |
| 4,268,729 | 5/1981 | Gaizauskas | 200/50.3 |
| 4,335,286 | 6/1982 | Nelson | 200/50.31 X |
| 4,414,440 | 11/1983 | DeCoste | 200/50.31 |
| 4,503,293 | 3/1985 | Knecht | 200/50.3 |
| 4,506,121 | 3/1985 | Peterson et al. | 200/50.28 |
| 4,521,649 | 6/1985 | Nelson | 200/50.28 |
| 4,528,429 | 7/1985 | Dobson et al. | 200/50.28 |
| 4,553,000 | 11/1985 | Appleton | 200/50.3 |
| 4,575,595 | 3/1986 | Gill | 200/50.3 |
| 4,604,505 | 8/1986 | Henninger | 200/50.3 |
| 4,659,160 | 4/1987 | Jonval | 439/187 |
| 4,772,215 | 9/1988 | Falk | 439/188 |
| 4,970,355 | 11/1990 | Haeusslein et al. | 200/50.31 |
| 5,212,624 | 5/1993 | Johnson et al. | 200/50.31 |
| 5,298,701 | 3/1994 | Sandor | 200/50.31 |
| 5,448,027 | 9/1995 | Hoffman et al. | 200/50.31 |

FOREIGN PATENT DOCUMENTS

| | | | |
|---|---|---|---|
| 2342805 | 10/1979 | Germany | H01R 13/70 |
| 3513591 | 5/1989 | Germany | H01R 13/707 |

OTHER PUBLICATIONS

Hubbell/Pin & Sleeve/The New Generation Catalog 1996.

*Primary Examiner*—J. R. Scott

*Attorney, Agent, or Firm*—Bond, Schoeneck & King, LLP; Stephen B. Salai

[57] ABSTRACT

A housing and interlock mechanism for a high current electrical switch, wherein the interlock mechanism precludes disruption of the circuit when the circuit is energized or under load. The interlock mechanism includes a lever arm for rotating a transfer gear to slidably desplace an elongated drive bar for simultaneously rotating an actuation gear for actuating the switch and an interlock gear for selectively engaging the plug.

20 Claims, 10 Drawing Sheets

SWITCH OPERATOR WITH INTERLOCK MECHANISM

FIELD OF THE INVENTION

The present invention relates to a high current switch operator and housing enclosing a switch and a receptacle, and more particularly, to a housing having a side mounted lever arm and an interlock mechanism which cooperate to prevent operation of the switch unless a plug is properly inserted in the receptacle and insertion or removal of the plug when the switch is energized, wherein the lever arm rotates about an axis orthogonal to the switch axis and the axis of an interlock gear.

BACKGROUND OF THE INVENTION

The use of equipment including industrial processors requiring relatively high currents is becoming increasingly common. In the powering of such equipment, it is considered unsafe to allow a switch to be moved to the "on" position in the absence of a properly inserted plug. Attempting to insert or remove a plug from an energized receptacle, especially with a load connected to the plug, can result in arcing between the plug and receptacle with damage to the components as well as creating a substantially safety hazard to personnel. To prevent this occurrence, switches are often enclosed within a housing and commonly provided with some type of interlock mechanism.

These switch enclosures are often employed in environments requiring certain sanitary conditions such as food processing stations. To maintain the sterility of the food processing environment, the entire system must be periodically cleaned. In the cleaning process, the switch houses are subjected to substantial water pressure. However, the water pressure is not uniformly distributed about the housing and may often impact only parts of the housing. Therefore, if there are any recesses, or grooves in the housing, these may tend to accumulate matter and reduce the effective cleaning. Face mounted switch operating handles are particularly exposed to the environment and the cleaning process and may provide access for fluid penetration of the housing.

U.S. Pat. No. 5,298,701 to Sandor, discloses a high current switch operator mounted in a closed housing having a switch and a receptacle, wherein the housing includes an interlock mechanism to prevent operation of the switch to the ON position unless a plug is properly inserted in the receptacle. A face mounted handle is attached to a shaft which directly turns a gear (designated the second gear) which carries the interlocking components.

The Sandor interlocking components include a stepped recess in the second gear and a latch for engaging the recess when the handle is in the OFF position, a second recess in the second gear adjacent the first recess captures the latch and prevents further movement of the handle when the plug is not fully inserted. A first gear of equal size is coupled to the second gear and operates the switch when the handle is moved and a third gear is interposed between the first and second gears for ensuring concurrent rotation of the switch and the handle. In such a system of gears the handle directly turns the second gear that carries the recess, which recess rotates in synchronism with the handle, and since the first gear also rotates in synchronism with the handle the amount of force applied to the gears is the same and limited to that needed to rotate the switch.

SUMMARY OF THE INVENTION

The present invention provides a switch operator for moving a switch between an OFF and an ON position to selectively energize a receptacle. The present invention includes a housing for substantially enclosing the switch and the receptacle, the housing having a face panel, a side panel, a plug port operably aligned with the receptacle and a lever arm port in the side panel; a shaft sealably mounted to the lever arm port to dispose an inner portion of the shaft inside the housing and an outer portion of the shaft outside the housing; a lever arm attached to the outer portion of the shaft for rotating the shaft; an interlock mechanism mounted on the inside of the housing to prevent operation of the switch unless a plug having an external key engages the interlock mechanism. The interlock mechanism of the present invention includes an actuation gear for operating the switch, an interlock gear for cooperating with a plug key; a driver bar slideably connected between the actuation gear and the interlock gear; and a transfer gear mounted on the inner portion of the shaft for rotation therewith and moveably connected to the interlock mechanism such that the lever arm is moveable between the OFF and the ON position when the plug key is engaged with the interlock mechanism.

In another aspect of the invention there is provided a switch operator for moving a switch between an OFF and an ON position when a plug having an external key is properly inserted, the switch operator including a lever arm; a transfer gear connected to the lever arm for rotation therewith; an elongated driver bar connected to the transfer gear, the driver bar having first, second and third spaced apart groups of gear engaging surfaces, the first group of gear engaging surfaces being cooperatively aligned with the transfer gear in a substantially rack and pinion relationship; an actuation gear cooperatively engaging the second group of gear engaging surfaces such that upon linear motion of the driver bar, the actuation gear is rotated; an actuation shaft connected to the actuation gear having a terminal end for engaging the switch and moving the switch between OFF and ON positions in response to rotation of the actuation gear; an annular interlock gear cooperatively engaging the third group of gear engaging surfaces; a recess defined in the inner circumference of the interlock gear; and an arming pin having an end for initially engaging the recess when the interlock gear is in a position corresponding to the OFF position of a switch to prevent rotation of the interlock gear, the arming pin being biased by a compression spring, the arming pin being located in a path to be displaced from the recess by the plug key when the plug is inserted into a receptacle, whereby full insertion of the plug releases the arming pin from the interlock gear and allows linear motion of the driver bar.

The novel aspects of this invention a re set forth with particularity in the appended claims. The invention it self, together with further objects and advantages thereof may be more fully comprehended by reference to the following detailed description of a presently preferred embodiment of the invention taken in conjunction with the accompanying drawings.

DETAILED DESCRIPTION OF THE PREFERRED EMBODIMENTS

Figure 1:
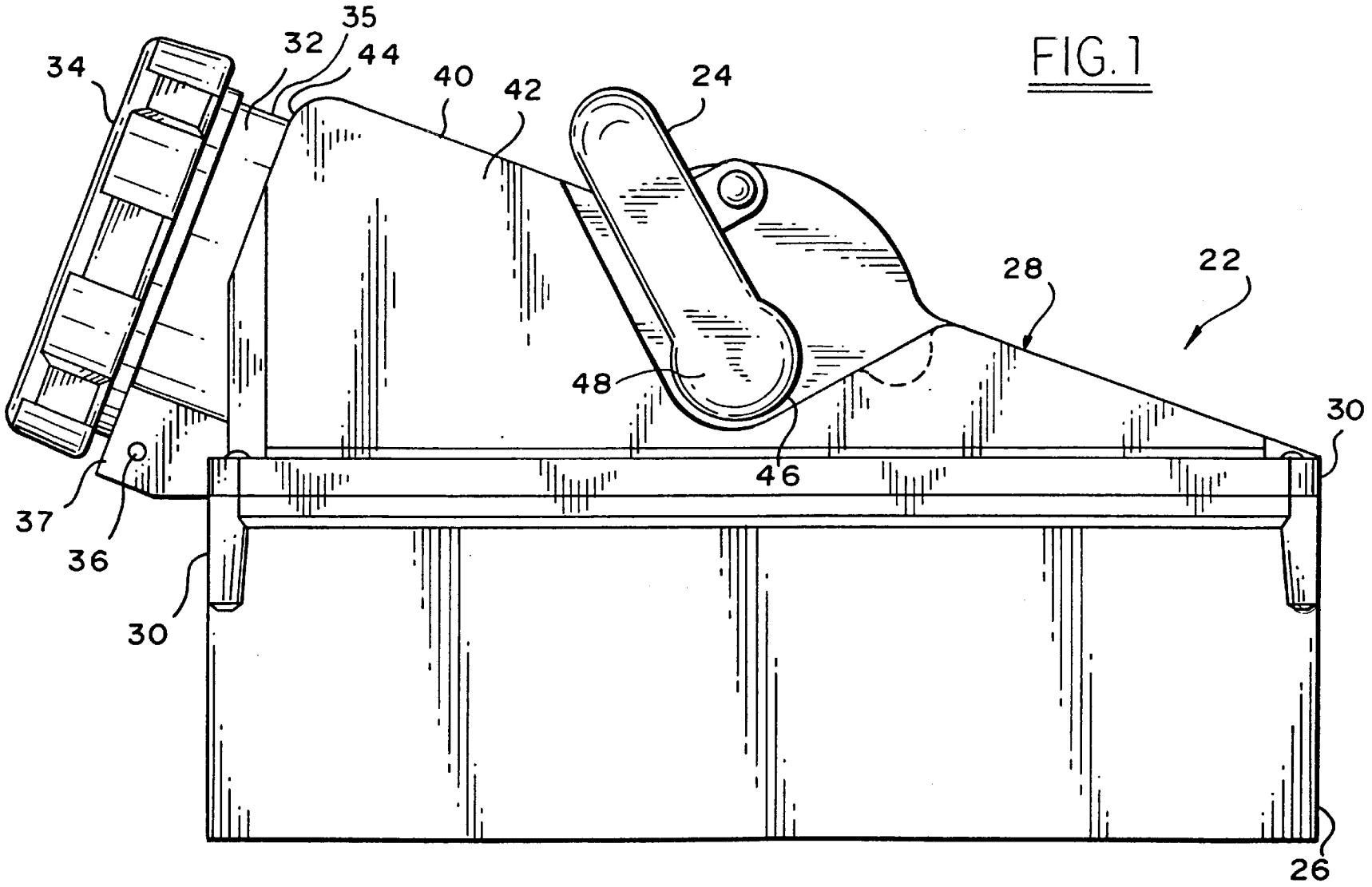
FIG. 1 side elevation view of a switch housing having a switch handle and incorporating a receptacle and an interlock mechanism.
Figure 2:
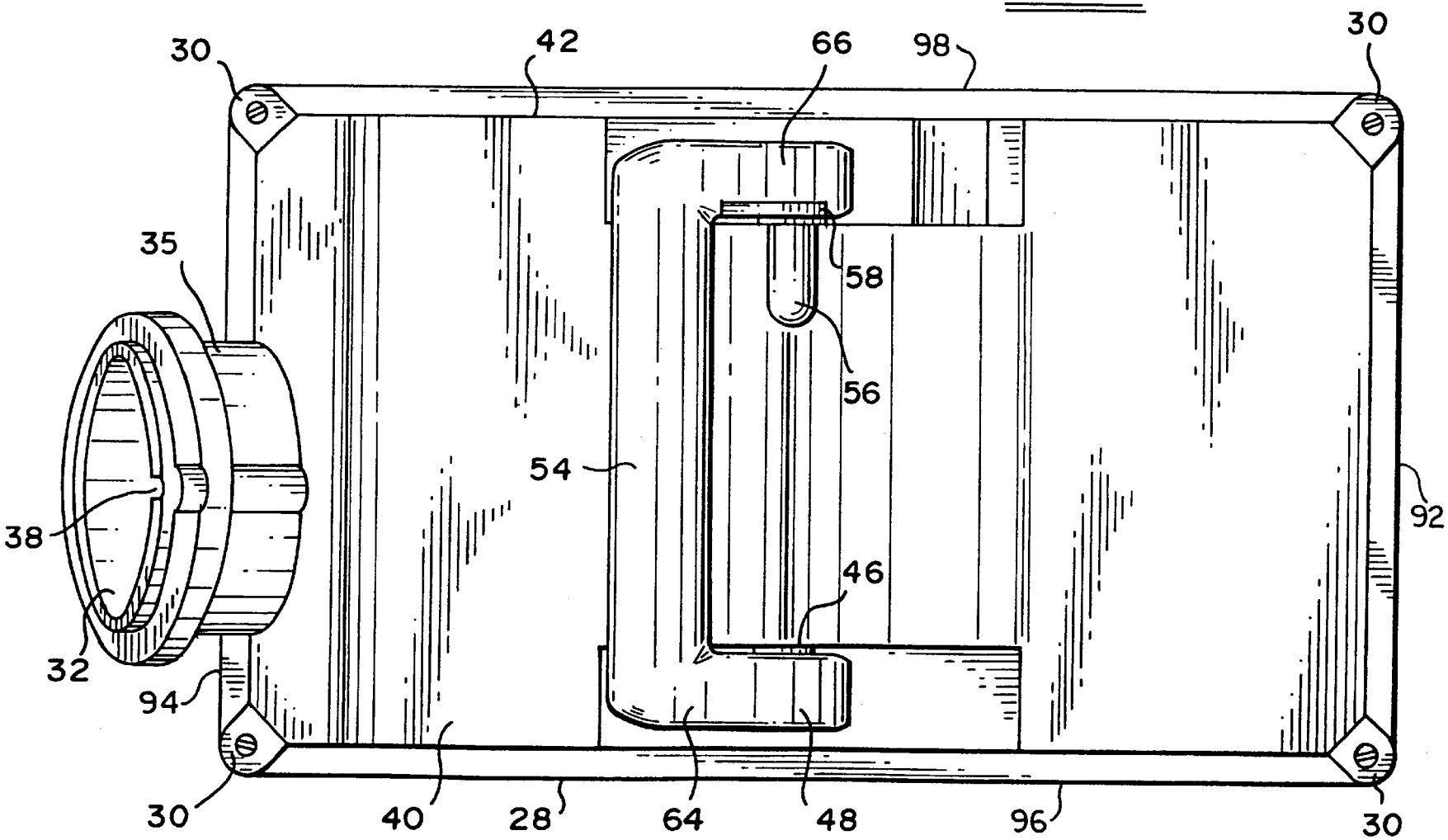
FIG. 2 is top view of the housing of FIG. 1.

As shown in FIGS. 1 and 2, the switch operator of the invention cooperates with a housing 22 sized to enclose a switch 70 and a receptacle 80. A lever arm 24 is connected to the housing 22 and is moveable between an ON and OFF position to cooperate with an interlock mechanism 130 to selectively permit and preclude actuation of the switch.

The housing includes a base 26 in the form of a generally rectangular box and a housing cover 28 which has a generally triangular shaped side profile and a generally rectangular opening. The base 26 and housing cover 28 include corresponding seals and seal faces to provide a substantially liquid tight interface. One of the base 26 and housing cover 28 may include a peripheral recess into which a resilient seal is disposed, and the remaining one of the base and cover includes a corresponding seal face for contacting the seal. The base 26 and the housing cover 28 are fastened together with screws at the corners 30 of the base and cover to form a substantially water tight housing.

The base 26 has a rectangular periphery and includes a back wall 90, a pair of parallel opposed end walls 92, 94 and a pair of parallel opposed side walls 96 and 98. A line port for connecting a power source is conveniently formed in the wall 92.

Figure 5A:
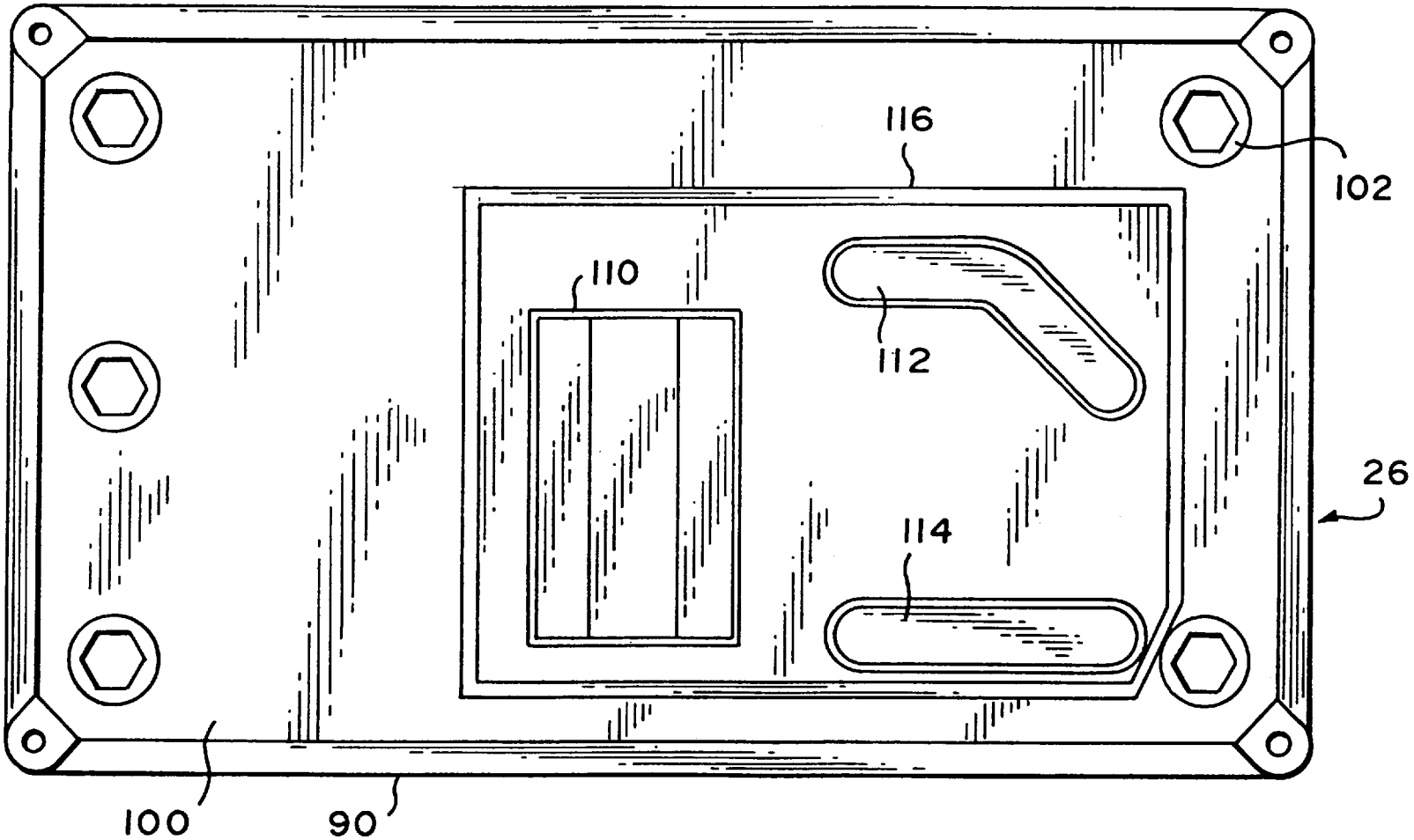
FIG. 5B is a rear view of the housing in which a plate covers the draft features rear view of the housing of FIG. 1.

Referring to FIG. 5A, an outside surface 100 of the back wall 90 includes a plurality of recesses 102 for receiving a plurality of self locking feet. Each foot cooperates with a configured recess 102 such that the frictional interface between the foot and corresponding recess precludes rotation of the foot relative to the base. The configuration in the recess includes a center post for mounting the foot. A threaded fastener such as a screw or a bolt may be passed through a portion of the foot into the post to prevent unintended separation of the foot from the base.

Figure 5B:
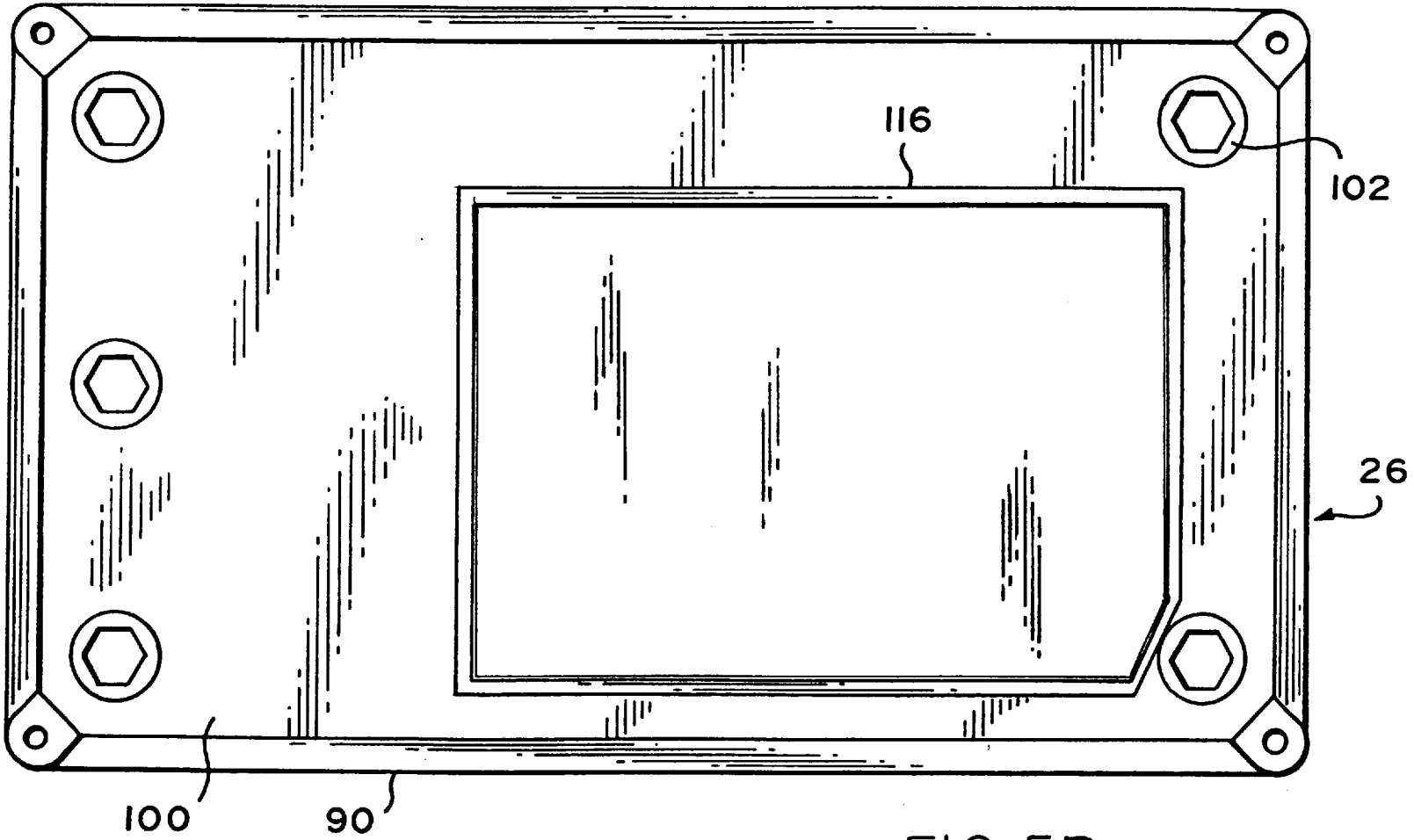

In addition, the back wall 90 may include draft features 110, 112, 114 required for the fabrication of the base 26 as shown in FIG. 5A. As these draft features form recesses into which environmental contaminants may accumulate, the draft features are recessed from an adjacent portion of the back wall 90. Preferably, the back wall 90 includes a peripheral shoulder 116 surrounding the recessed draft features. As shown in FIG. 5B, a plate or panel may be disposed in the peripheral shoulder 116 to substantially enclose the draft features 110, 112, 114 and thereby form a substantially gap free and continuous surface of the housing 22. The plate is fastened to the base 26 by adhesives or ultrasonic bonding.

The housing cover 28 includes a generally rectangular face panel 40 and a pair of spaced apart side panels 42 extending from the face panel. The side panels 42 have a triangular periphery. A front panel 44 extends between the side panels and interconnects the side panels 42 with the face panel 40. The front panel 44 includes a plug port 32. The plug port 32 has a wall 35 extending out from the front panel 44 with a collar formed around the outer end of the port. A channel 38 is formed in the wall 35 and extends the length of the port 32 to accommodate a key 86 on the plug when the plug is inserted.

The housing cover 28 includes a cap 34 for sealing the plug port 32 when the plug is not present. The cap 34 is preferably a twist cap with a rubber liner for sealing with the port 32 when the cap is tightened. A hinge pin 36 cooperates with a hinge 37 attached between the cap 34 and the plug port 32 to retain the cap with the housing cover 28 when the plug is in place. A spring cooperates with the hinge pin 36 and the cap 34 to urge the cap to a closed position.

Figure 3:
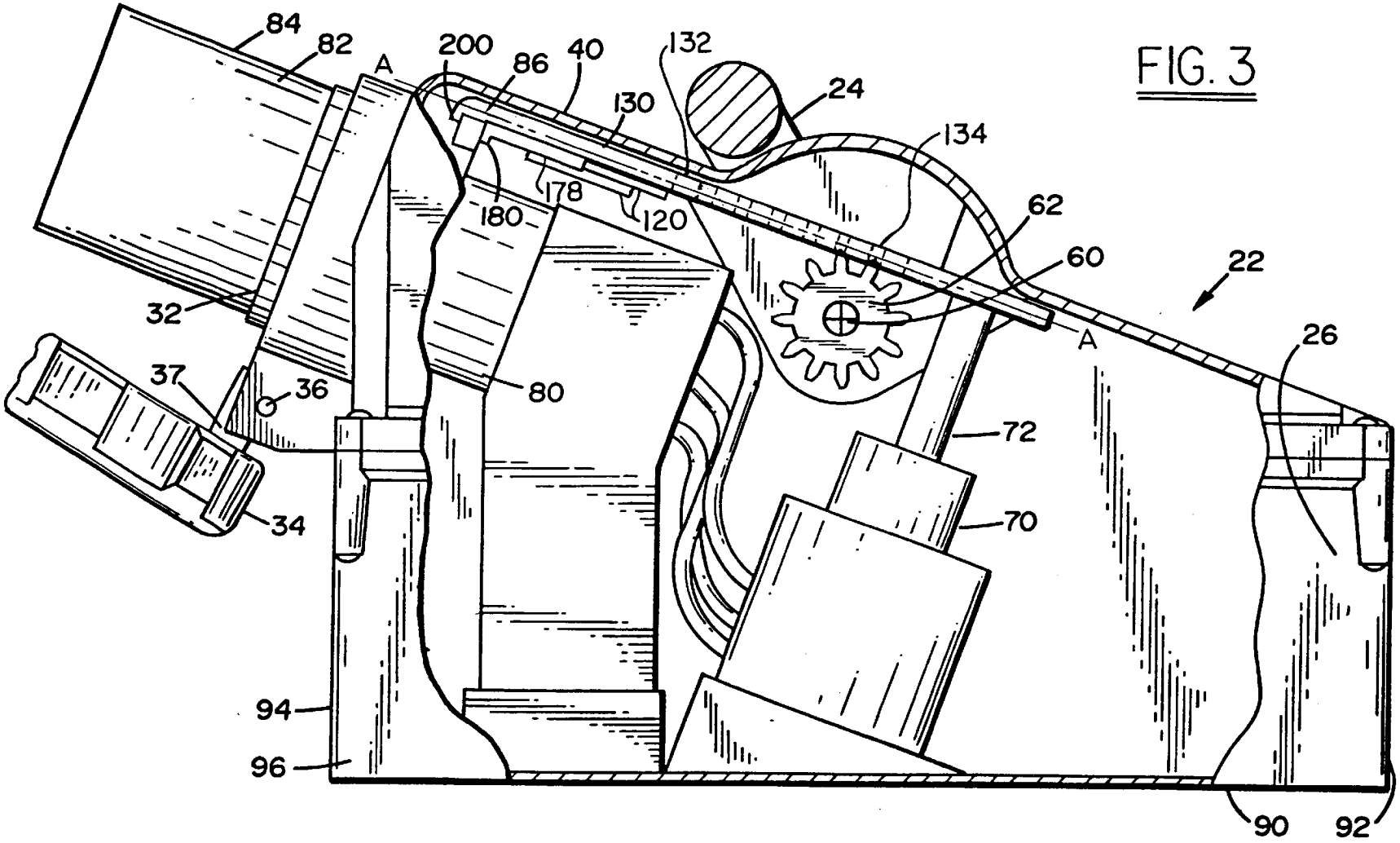
FIG. 3 is a side elevation view of the housing partly cut away to show the location of a the interlock mechanism.

The housing cover 28 also includes a lever arm port 46 which extends through one of the side panels 42 and accommodates a pivot end 48 of the lever arm 24. Referring to FIG. 3, the lever arm 24 is connected to a lever arm shaft 60 which is sealably mounted to the lever arm port 46 and extends into the housing 22. A transfer gear 62 is mounted on an inner portion of the shaft 60 for rotation therewith in response to movement of the lever arm 24.

Referring to FIGS. 1 and 2, the lever arm 24 may form a portion of the handle 54 which in turn is a substantially L-shaped or U-shaped member. In the preferred embodiment, the handle 24 is substantially U-shaped, wherein one arm 64 of the handle forms the lever arm and the remaining arm 66 is pivotally attached to an outer surface of the housing cover 28 by the slot 56 in the housing cover for accommodating the shank of a lock. A ring tab 58 extends from the remaining arm 66. The handle 54 may be of a variety shapes such as the "U" shape, "L", or "T" shaped. This fire alarm type handle 24 thus is pivoted on two handle ends on a common axis extending through the housing 22. In addition, the handle 24 includes contrasting colors, wherein a first one of the contrasting colors, for example black, is predominately visible when the handle is in the OFF position and the second contrasting color, for example red, is predominately visible when the handle assumes the ON position.

Figure 4:
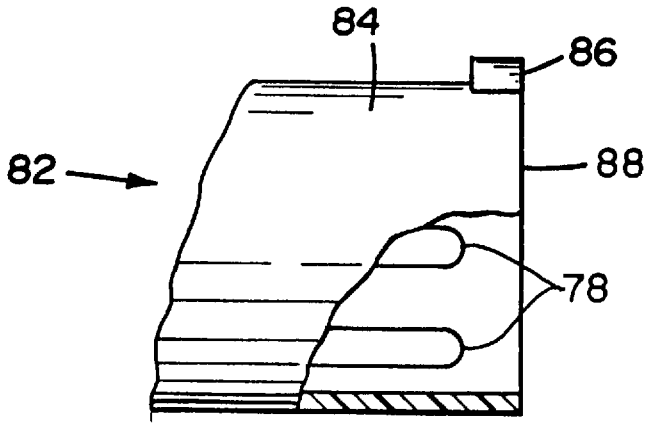
FIG. 4 is a side elevation view of a plug partly cut away to show the sleeve and pin arrangement.

As shown in FIG. 3, the conventional electrical switch 70 is mounted inside the base 26, the switch having a rotatable switch shaft 72 attached to a coupling member 142 which cooperates with the interlock mechanism 130 to rotate the switch between the OFF and ON positions. The receptacle 80 is mounted in the base 26 and electrically connected to the switch 70. The receptacle 80 is aligned with the plug port 32 to receive a plug 82 when it is inserted through the port. The electrical plug, as shown in FIG. 4, for connecting to the receptacle 80 is preferably of the pin and sleeve type, and being well known, will not be further described (pins 78 are shown in the cut away portion of plug 82 in FIG. 4). The plug 82 to be used with the interlock mechanism of the invention includes a key 86 on an outer surface 84. The key 86 is formed at a leading end 88 of the plug. The key 86 is received in channel 38 and passes completely there through when the plug 82 is fully inserted. The key 86 does not require any substantial axially length, rather it merely interacts with the interlock mechanism 130. The axial length of the key 86 is such that when the plug 82 is fully inserted, the key 86 is fully within the housing having passed entirely through the channel 38.

Referring to FIGS. 6, 7, 8A, 8B, and 8C, there is shown the interlock mechanism 130 of the invention in three different operating positions.

The interlock mechanism 130 includes an interlock gear 160, a driver bar 132, a transfer gear 62 and cooperates with an actuation gear 142. These components are operably retained with respect to housing cover 28 by an inner cover 120. The interlock mechanism 130 of FIG. 6, which depicts the interlock mechanism when the switch 70 is in the OFF position, includes an elongated, flat driver bar 132 which is slidably mounted with respect to the housing cover 28 and specifically to the inside of the face panel 40. The driver bar 132 has a first set of gear engaging surfaces which are, preferably, a plurality of slots 134 within the perimeter of the bar. The slots 134 are cooperatively aligned with the teeth 64 of the transfer gear 62 in a substantially rack and pinion relationship. An end of the driver bar 136 adjacent to the switch 70 and spaced from the shaft 60 is generally U-shaped and has a second group of gear engaging surfaces, preferably, in the form of a plurality of teeth 138 on the outside edge of an outer leg 140. An actuation gear 142 is also connected to the housing cover 28 for rotation with respect to the cover. The teeth 144 of the actuation gear 142 cooperatively engages the teeth 138 such that upon linear motion of the driver bar 132, the actuation gear 142 is rotated. An opposite end 150 of the driver bar 132 has a third group of gear engaging surfaces, preferably a plurality of teeth 152, on the inner edge of the bar. The first gear engaging surfaces 134 are intermediate the second and the third gear engaging surfaces 138, 152.

An annular interlock gear 160 is connected to the housing cover 28 for rotation with respect to the cover. The interlock gear 160 is mounted on a circular boss 162 and has a plurality of teeth 164 on a portion of the gear which cooperatively engage the teeth 152 of the driver bar 132 such that upon linear motion of the bar, the interlock gear is rotated. A generally U-shaped recess 166 is defined in an inner circumference of the interlock gear 160. The recess 166 aligns with the channel 38 of the port when the switch is in the OFF position.

In the preferred embodiment, the interlocking gear 160 has twice the diameter of the actuation gear 142 and the actuation gear has the same diameter as the transfer gear 62. However, it is understood the size ratio of the interlock gear 160 and actuation gear 142 may be any of a variety of ratios. Preferably, the interlock gear 160 has a larger diameter than the actuation gear 142.

The interlock gear 160 cooperates with an arming pin 170. The arming pin 170 is biased by a compression spring 172 into the recess 166 to initially preclude the rotation of the interlock gear. The arming pin 170 and spring 172 are located within the inner rim of the interlock gear 160 in a path defined by the housing cover 28 and inner cover 120 such that the arming pin can be moved out of the recess by the key 86 when the plug 82 is inserted into the receptacle.

Figure 9:
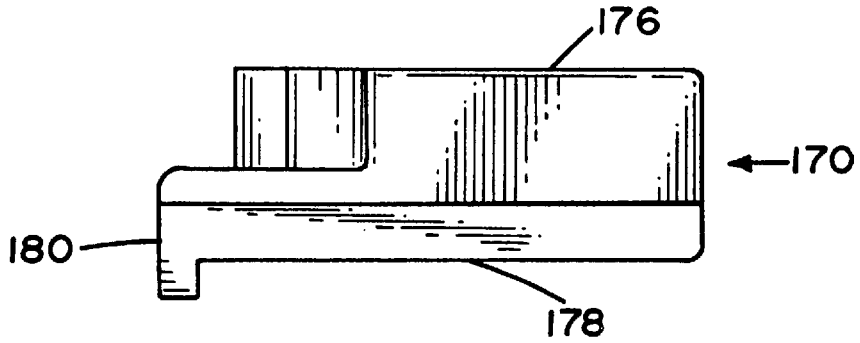
FIG. 9 is a side elevation view of the arming pin.
Figure 10:
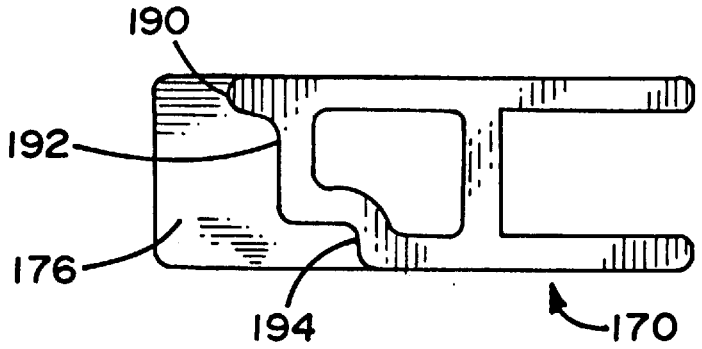
FIG. 10 is a top view of the upper surface of the arming pin.
Figure 11:
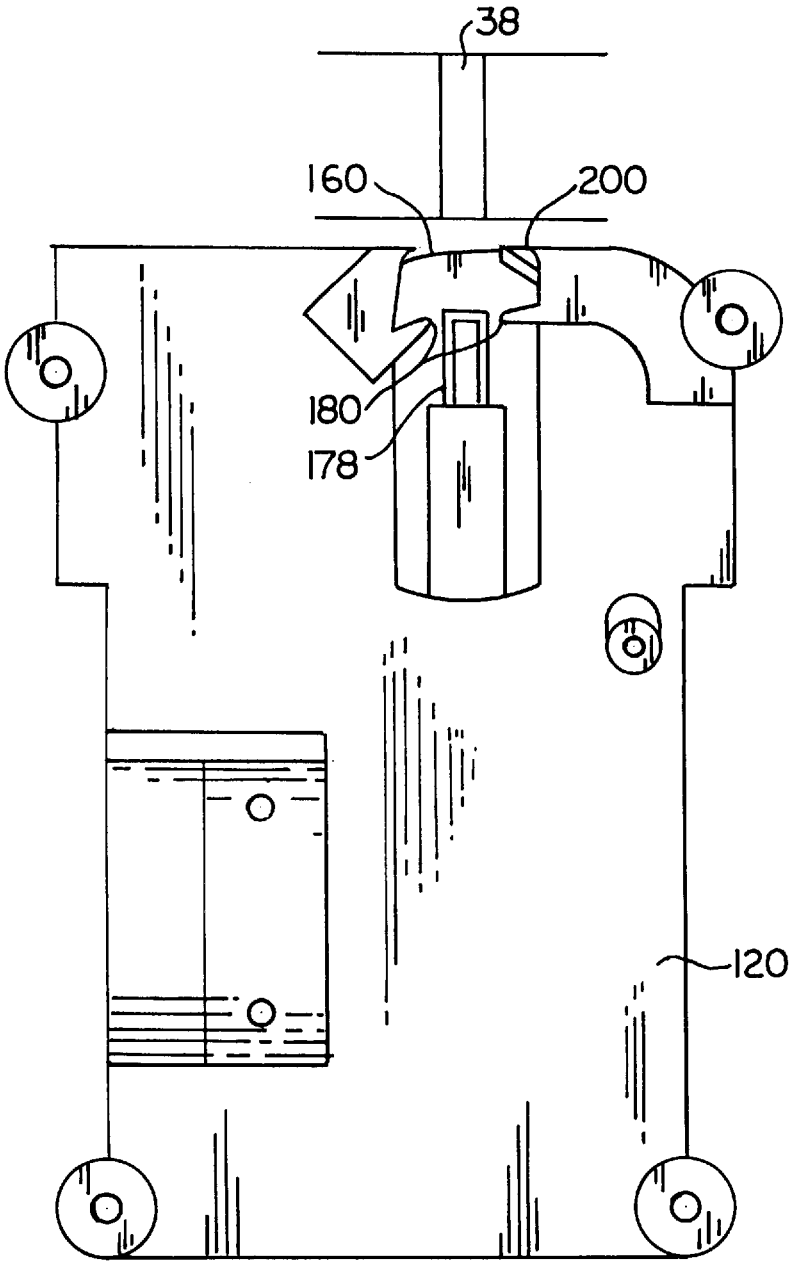
FIG. 11 is a view of the inner cover mounted in the housing cover.

Referring to FIGS. 3, 9 and 10, the arming pin 170 has an upper surface 176 facing the inner surface of the face plate 40 and a lower surface 178. A tab 180 extends downward from the lower surface 178 at the plug end of the pin. The tab 180 is sized to be engaged by the key 86 when the plug 82 is inserted, resulting in the arming pin 170 being moved out of the recess 166 in the interlock gear 160 and rotation of the interlock gear is made possible. The upper surface 176 of the arming pin 170 is formed with a tip 190 for engaging the inside rim of the interlock gear when the arming pin is moved out of the recess 166. The upper surface also has a first step 192, and a second step 194 for engaging the trailing shoulder of the recess 166 as the arming pin is moved in and out of the recess on rotation of the interlock gear 160.

The interlock gear 160 also includes a follower arm 200 (FIGS. 3 and 6) mounted on the outer circumference of the gear and extending downwards so that when the interlock gear is rotated, the lever arm 24 being disposed into the ON position, and the plug 82 is fully inserted the follower arm captures the key 86 and prevents removal.

Figure 6:
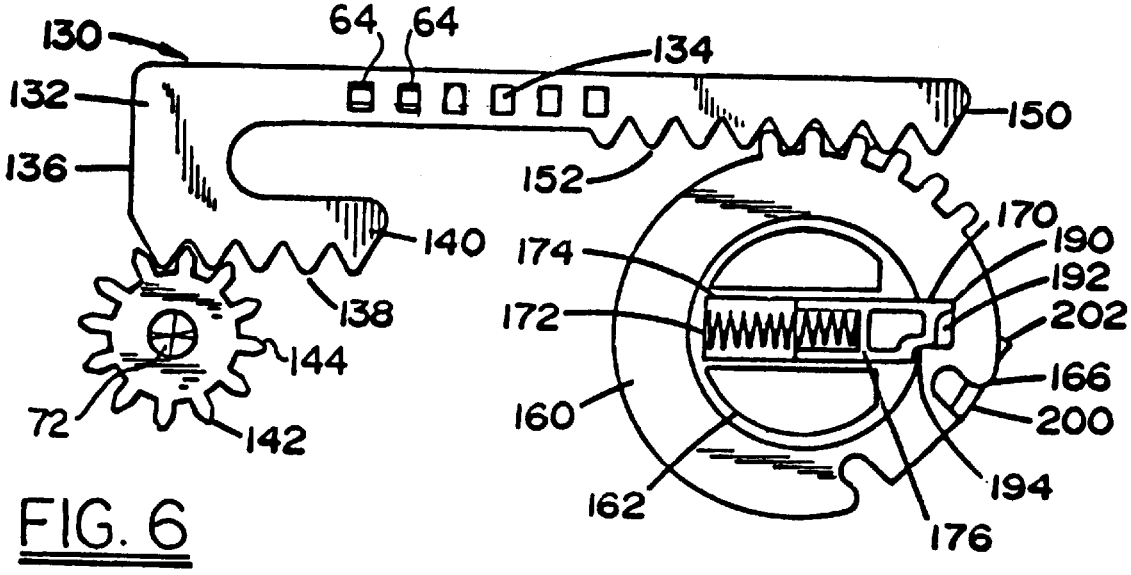
FIG. 6 is a partial view of the interlock mechanism viewed from the with the switch in the OFF position.

FIG. 6 shows the tip 190 and the step 192 of the arming pin 170 fully inside the recess 166 so that the interlock gear 160 cannot be rotated. The second step 194 of the arming pin 170 engages the trailing shoulder of the recess 166 to limit the length of the pin inserted into the recess. The end 202 of the follower 200 is rotated out of alignment with the path of the arming pin 170. This alignment corresponds to the OFF position of the switch and handle 24.

Figure 7:
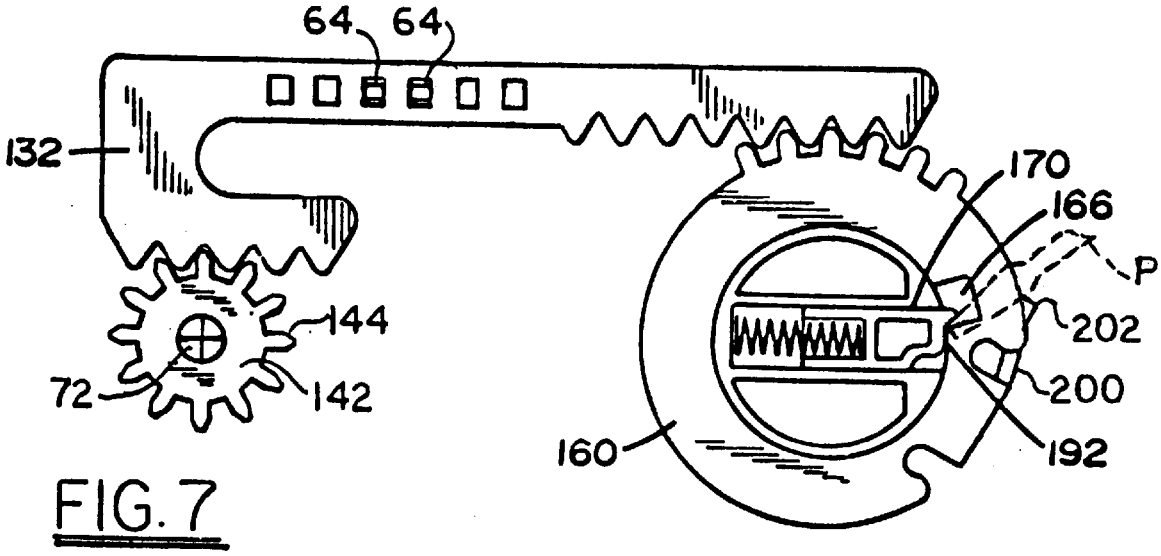
FIG. 7 Is a partial view of the interlock mechanism viewed from the top with the switch in the intermediate position.

FIG. 7 shows the arming pin 170 partially removed from recess 166 so that the first step 192 of the arming pin engages the trailing shoulder of the recess preventing further rotation of the interlock gear 160. The end 202 of the follower 200 is rotated into partial alignment with the path of the arming pin 170.

Figure 8A:
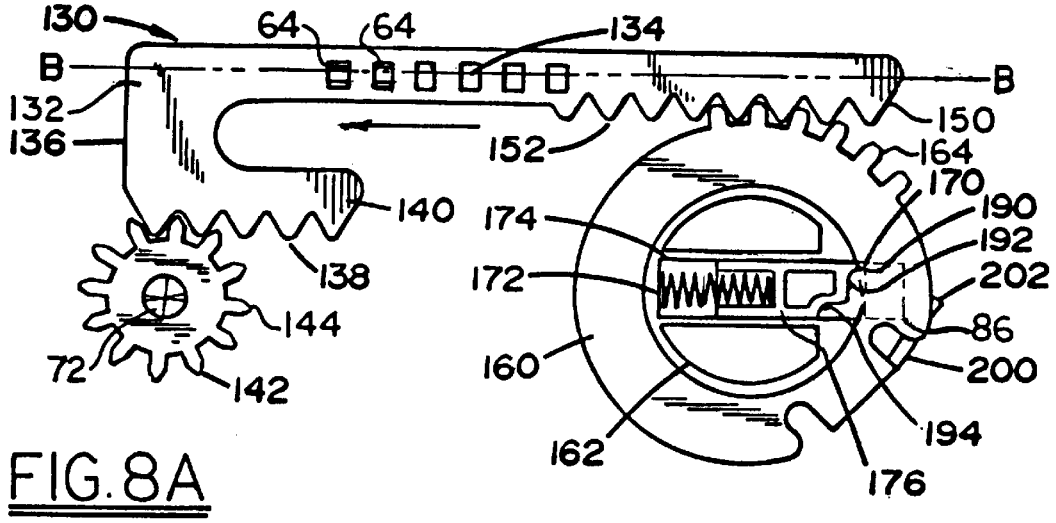
FIG. 8A, 8B, and 8C are partial view of the inter lock mechanism viewed from the top with the switch in the ON position.
Figure 8B:
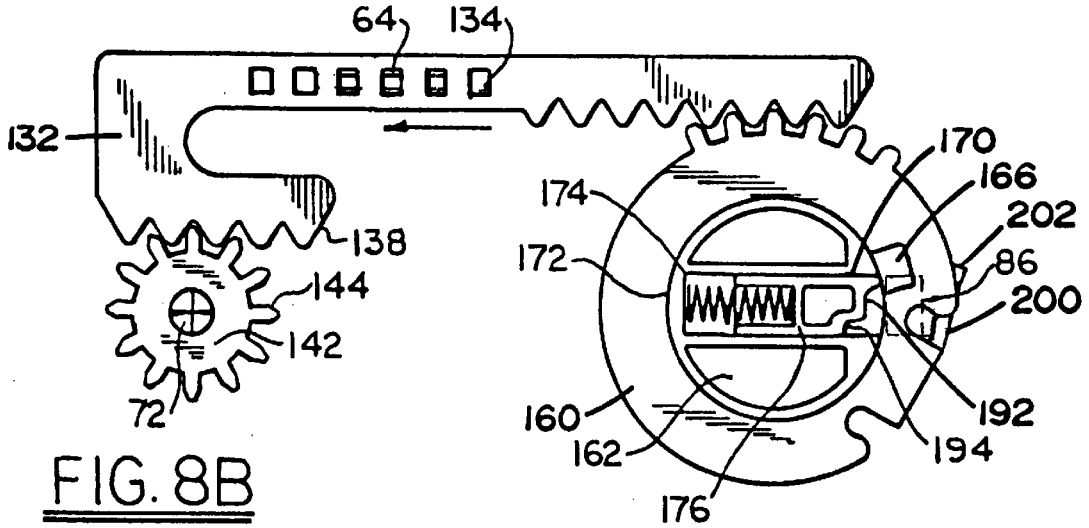

FIG. 8A and 8B show the interlock mechanism engaged with a plug key in positions corresponding to the OFF position of the switch 70 and handle 24 and an intermediate position, respectively.

Figure 8C:
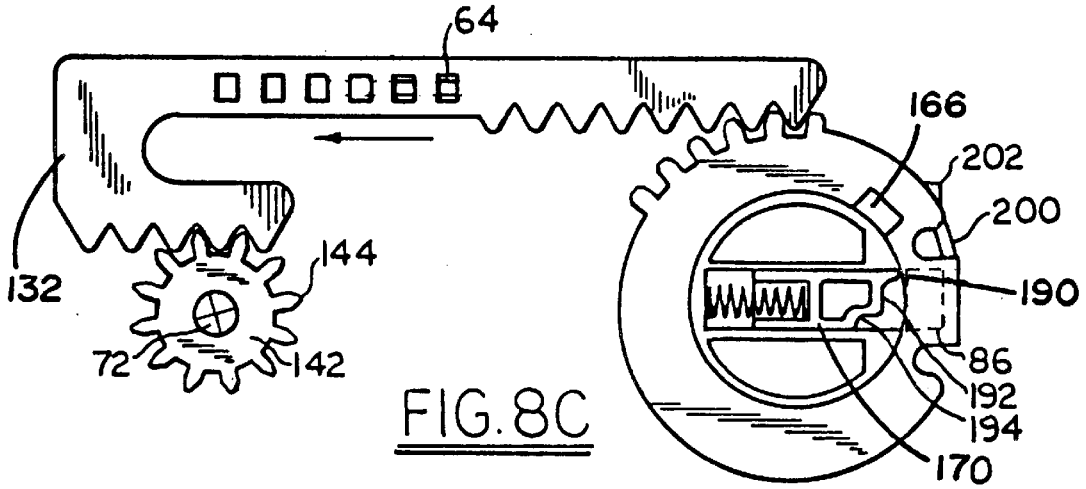

FIG. 8C shows the tip 190 of the arming pin 170 fully removed from the recess 166 so that the interlock gear is fully rotatable to the extent of its toothed engagement with drive bar 132. The follower 200 is rotated into alignment with the path of arming pin 170. This alignment corresponds to the ON position of the switch 70 and handle 24.

The lever arm 24 rotates through a 90° range of motion and if the actuation gear 142 and the transfer gear 62 are identical, the 90° lever rotation causes a corresponding 90° rotation on the switch 70 thereby fully moving the switch between the ON and OFF positions. The sizing of the interlock gear 160 is such that the 90° rotation of the handle imparts only a 45° rotation of the interlock gear. As the interlock gear 160 rotates through a reduced range, the effective force as the interlock gear rotates is greater than the actuation gear so as to overcome any alignment and binding considerations upon insertion of the plug and to accommodate the anti-picking mechanism.

The housing cover 28 includes an inner cover 120 attached to the inside of the face panel 40 for retaining the interlock mechanism 130. In a preferred embodiment the inner cover 120 also encloses the shaft 60 and the transfer gear 62.

In an alternative embodiment the interlock mechanism may include a lock bar interconnected between the interlock gear 160 and an actuation gear 142. One end of the interlock bar engages the plug key and cooperates with the interlock gear, the other end of the lock bar engages a pair of recesses in the actuation gear 142. The interlock bar slideably engages the transfer gear in a rack and pinion relationship responsive to operation of the lever arm. The lock bar selectively engages the actuator gear and the interlock gear and is displaced only upon insertion of the plug.

Operation

In operation, the plug 84 is inserted through the plug access port 32, and the key 86 engages the tab 180 on the arming pin 170 and releases the interlock gear 160 by moving the arming pin out of the recess 166. Upon seating the plug in the receptacle, the lever arm 24 is allowed to be moved from the OFF to the ON position, thereby rotating the transfer gear 62. Prior to and during insertion of the key 86, rotation of the interlock gear 160, drive bar 132, transfer gear 62 and hence handle 24 is precluded by contact of the arming pin 170 within the recess 166.

Referring to FIGS. 6 or 7, if one inserts a probe into the plug port so that it presses the tab 180 out of the recess 166 and then turns the lever arm 24 to try to turn the switch ON, the interlock gear 160 and follower 200 rotates so that the follower end 202 hits the probe and it is necessary to remove the probe to continue rotation. However, second step 194 on the arming pin 170 engages the trailing shoulder of the recess 166 preventing rotation of the interlock gear 160 and thus actuation of the switch with a probe is prevented. Specifically, the present configuration resists "picking" of the interlock mechanism 130 in that upon partial insertion of a picking device, such as an elongate screw driver blade, the blade contacts and displaces the arming pin 170 such that rotation of interlock gear 160 to contact the trailing edge of recess 166 along the first step causes the following arm 200 to cross the longitudinal extensions of the arming pin. As the following arm 200 passes across the access to the arming pin, the "picking" blade is displaced from contact with the arming pin 170 and further rotation of the interlock gear 160 is precluded.

In contrast, as shown in FIGS. 8A, 8B and 8C, in proper operation the following arm 200 would pass behind the key 86 such that the key is intermediate the following arm and the arming pin 170, thereby allowing the arming pin to be fully displaced from the recess 166 so that pin 190 rides along the inner periphery of the interlock gear 160. The transfer gear 62 rotates and thereby moves the drive bar 132 with respect to the housing cover 28. As the drives bar 132 moves, the drives bar turns the interlock gear 160 and accompanying follower 200 and simultaneously turns the actuation gear 142. The actuation gear 142 thus engages the actuation shaft 72 to dispose the switch 70 in the ON position.

On seating the plug in the receptacle, the key 86 becomes disposed entirely within the outside periphery of the interlock gear 160 and, as a result of rotation of the interlock gear in response to moving the lever arm 24 to the ON position, the following arm 200 is disposed between the key 86 and the channel 38 and removal of the plug is prevented when the switch (handle) are in the ON position.

In the reverse operation, movement of the lever arm 24 from the ON to the OFF position rotates the transfer gear 62 in the reverse direction thereby moving the drive bar 132 in the reverse direction. As the drive bar moves, it simultaneously turns the actuation gear 142 to dispose the switch to the OFF position and rotates the interlock gear 160 so that the following arm 200 is moved out of alignment with the key 86 and the plug can then be removed. As the plug is removed the arming pin 170 moves into the recess 166 under the force of the spring 172 and prevents further movement of the lever arm 24.

Contrary to the prior art devices in which the axis of rotation of the switch 70 aligns with the axis of rotation of the operating handle, the present construction allows off axis design. Furthermore, the arrangement of gears of the interlock mechanism 130 is such that the gears comprise an actuation gear 142 for operating the switch 70, an interlock gear 160 which carries the interlock components, a driver bar 132 slideably connected between the actuation gear and the interlock gear and a transfer gear 62 connected between the lever arm 24 and the driver bar 132, which allows for different gear ratios between the lever arm and the actuation gear and between the lever arm and the interlock gear. Hence, the force applied to operate the interlock gear 160 can be greater than the force applied to operate the actuation gear 162 when the lever arm 24 is rotated between the OFF and ON positions.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A switch operator comprising:

a switch;

an activation gear coupled to the switch;

an interlock gear adapted to cooperate with a plug key for rotation only when a plug is engaged with the plug key; and a driver bar coupled to the actuation gear and the interlock gear.

2. The switch operator of claim 1, further comprising a transfer gear coupled to the driver bar.

3. The switch operator of claim 2, wherein rotation of the transfer gear slidably displaces the driver bar.

4. The switch operator of claim 3, further comprising a drive shaft, the transfer gear being operably connected to the drive shaft.

5. The switch operator of claim 4, further comprising a handle having a first end and a second end, the drive shaft being attached to the first end of the handle.

6. The switch operator of claim 5, further comprising a housing cover for pivotally supporting the handle.

7. The switch operator of claim 6, further comprising an inner cover attached to the housing cover.

8. The switch operator of claim 7, wherein the interlock gear, the activation gear, the transfer gear, the drive shaft, and the driver bar are operably aligned between the housing cover and the inner cover.

9. The switch operator of claim 8, wherein the driver bar is U-shaped.

10. The switch operator of claim 9, wherein the driver bar comprises slots for retaining gear teeth.

11. The switch operator of claim 10, wherein the interlock gear has an outer circumference and an inner circumference, the transfer gear has an outer circumference, and the actuation gear has an outer circumference.

12. The switch operator of claim 11, wherein the interlock gear has teeth along at least a portion of its outer circumference, the transfer gear has teeth along at least a portion of its outer circumference, and the actuation gear has teeth along at least a portion of its outer circumference.

13. The switch operator of claim 12, wherein the driver bar has two ends and teeth along at least a portion of each end.

14. The switch operator of claim 13, wherein the teeth of the transfer gear mesh with the slots of the driver bar to slidably display the driver bar in a linear direction.

15. The switch operator of claim 14, wherein the teeth of the interlock gear mesh with the teeth from one of the two ends of the driver bar to rotatably move the interlock gear and wherein the teeth of the actuation gear mesh with the teeth of the other of the two ends of the driver bar to rotatably move the actuation gear.

16. The switch operator of claim 6, further comprising a base, the base able to fit with the housing cover, and the base having a wall.

17. The switch operator of claim 16, wherein the wall of the base further comprises draft feature recesses required for the fabrication of the base, a peripheral shoulder surrounding the recessed draft features, and a plate disposed in the peripheral shoulder to cover the draft features to form a substantially gap free and continuous surface housing.

18. The switch operator of claim 16, in which the wall of the base further comprises a plurality of recesses for receiving a plurality of self-locking mounting feet, the plurality of recesses formed in the wall of the base wherein a frictional interface between one of the plurality of self-locking mounting feet and a corresponding one of the plurality of recesses precludes rotation of the one of the plurality of self-locking mounting feet.

19. The switch operator of claim 5, wherein the handle includes a first and a second contrasting color, the handle being switchable between an OFF position and an ON position, wherein the first contrasting color is predominately visible when the handle is in the OFF position and the second contrasting color is predominately visible when the handle is in the ON position.

20. The switch operator of claim 6, wherein the second end of the handle comprises a ring tab;

wherein the housing cover comprises a slot to accommodate a shank of a lock;

wherein the ring tab and the slot of the housing cover are aligned when the handle is in the OFF position so as to pass a shank of a lock through the ring tab to secure the handle to the housing cover with a lock.

* * * * *